US008875668B2

(12) United States Patent
Bennington

(10) Patent No.: US 8,875,668 B2
(45) Date of Patent: Nov. 4, 2014

(54) APPARATUS CONFIGURED TO SHELTER OIL-JET DEVICE FROM INADVERTENT INSTALLATION DAMAGE

(75) Inventor: Gregg Bennington, Shelburne (CA)

(73) Assignee: Honda Motor Co., Ltd., Tokyo (JP)

( * ) Notice: Subject to any disclaimer, the term of this patent is extended or adjusted under 35 U.S.C. 154(b) by 28 days.

(21) Appl. No.: 13/601,565

(22) Filed: Aug. 31, 2012

(65) Prior Publication Data

US 2014/0060464 A1 Mar. 6, 2014

(51) Int. Cl.
*F01P 1/04* (2006.01)
*F01P 3/06* (2006.01)

(52) U.S. Cl.
CPC ..... *F01P 3/06* (2013.01)
USPC ..... 123/41.35; 123/41.45; 123/41.73

(58) Field of Classification Search
CPC ..... F01P 3/08; F01P 3/06; F01P 2003/006; F01M 2005/004; F16J 1/08
USPC ..... 123/41.35, 41.45, 41.73
See application file for complete search history.

(56) References Cited

U.S. PATENT DOCUMENTS

| | | | | |
|---|---|---|---|---|
| 4,010,718 | A | 3/1977 | Stewart | |
| 4,508,065 | A | 4/1985 | Suchdev | |
| 5,267,534 | A * | 12/1993 | Berlinger | 123/41.35 |
| 5,649,505 | A | 7/1997 | Tussing | |
| 5,896,656 | A | 4/1999 | Laws | |
| 6,672,262 | B2 * | 1/2004 | Bontaz | 123/41.35 |
| 6,895,905 | B2 * | 5/2005 | Bontaz et al. | 123/41.35 |
| 7,063,049 | B2 | 6/2006 | Kemp et al. | |
| 7,240,643 | B1 * | 7/2007 | Perr et al. | 123/41.35 |
| 7,549,402 | B2 * | 6/2009 | Issler | 123/41.35 |
| 8,065,984 | B2 * | 11/2011 | Issler et al. | 123/193.1 |
| 8,122,859 | B2 * | 2/2012 | Phelps et al. | 123/41.35 |
| 2005/0193964 | A1 * | 9/2005 | Kemp et al. | 123/41.35 |
| 2010/0001103 | A1 | 1/2010 | Neto et al. | |
| 2010/0031917 | A1 * | 2/2010 | Abe | 123/197.2 |
| 2011/0194967 | A1 * | 8/2011 | Watanabe et al. | 418/138 |

FOREIGN PATENT DOCUMENTS

| | | |
|---|---|---|
| JP | 2011163265 | 8/2011 |

* cited by examiner

*Primary Examiner* — Noah Kamen
*Assistant Examiner* — Long T Tran
(74) *Attorney, Agent, or Firm* — Standley Law Group LLP

(57) ABSTRACT

An apparatus includes an oil-jet emplacement assembly and an oil-jet sheltering assembly. The oil-jet emplacement assembly is configured to spatially emplace an oil-jet device at an installation position relative to an engine block of a vehicle. The oil-jet sheltering assembly is positioned relative to the oil-jet emplacement assembly. The oil-jet sheltering assembly is configured to protectively shelter the oil-jet device from inadvertent oil-jet installation damage.

19 Claims, 6 Drawing Sheets

APPARATUS CONFIGURED TO SHELTER OIL-JET DEVICE FROM INADVERTENT INSTALLATION DAMAGE

BACKGROUND

A cylinder block of a car or a truck (vehicle) is an integrated structure including cylinders of a reciprocating engine and often some or all of their associated surrounding structures (such as coolant passages, intake and exhaust passages and ports, and crankcase, etc.). The term engine block is often used synonymously with cylinder block.

Various main parts of an engine (such as cylinders, cylinder heads, coolant passages, intake and exhaust passages, and crankcase) are distinct assemblies; these assemblies may be instantiated as discrete pieces that are bolted together. Such construction was very widespread in the early decades of the commercialization of internal combustion engines (1880s to 1920s), and it is still sometimes used in certain applications where there is an advantage (especially for very large engines, but also some small engines). However, it is no longer the normal way of building most petrol engines and diesel engines, because for any given engine configuration, there are more efficient ways of designing for manufacture (and also for maintenance and repair). These generally involve integrating multiple machine elements (assemblies) into one discrete part, and doing the making (such as casting, stamping, and machining) for multiple elements in one setup with one machine coordinate system (of a machine tool or other piece of manufacturing machinery). This yields lower unit cost of production (and/or maintenance and repair). Today most engines for cars, trucks, buses, tractors, and so on are built with a fairly highly integrated engine block (cylinder block or block).

An oil-jet device is a device that is configured to spray oil to a piston assembly (such as a bottom portion of the piston assembly) of an engine block. The oil received by the piston assembly (from the oil-jet device) cools (removes heat from) the piston assembly during a combustion phase of engine-block operation. Other names for the oil-jet device are a piston-cooling nozzle or a system for cooling and lubricating the piston assembly in an internal combustion engine. During engine operation, some of the heat resulting from fuel combustion is absorbed by the piston assembly, causing an undesirable temperature rise. Without adequate heat transfer away from the piston assembly, the carbon deposits may be increased on the piston assembly. One way to reduce this excess heat is through use of the oil-jet device.

SUMMARY

A problem associated with known oil-jet devices is that during installation of an oil-jet device to an engine block, the oil-jet device may inadvertently contact the engine block, and in some instances the contact is severe and inadvertently inflicts damage to the oil-jet device. As a result of inadvertent contact, the oil-jet device may become disadvantageously bent or become operatively damaged. For example, for the case where the oil-jet device is not properly installed to the engine block, there is a risk that the improperly installed instance of the oil-jet device may inadvertently contact a section (such as a crank section) of the engine block during normal engine-block operation, and for this case abnormal (unwanted) engine noise may result, which has a negative impact on user enjoyment of the vehicle. As well, for the case where the oil-jet device is compromised (operatively damaged) during oil-jet installation (perhaps the oil-jet device becomes inadvertently pinched while making unwanted contact with the engine block), then catastrophic failure may occur due to overheating of the piston assembly of the engine block since the piston assembly failed to cool down during normal engine-block operation because the oil-jet device failed to convey or deliver a sufficient amount of oil (if any) to the piston assembly.

In order to mitigate, at least in part, the above noted problems, an apparatus has been developed that includes an oil-jet emplacement assembly configured to spatially emplace an oil-jet device at an installation position relative to an engine block of a vehicle. As well, the apparatus also includes an oil-jet sheltering assembly being positioned relative to the oil-jet emplacement assembly. The oil-jet sheltering assembly is configured to protectively shelter the oil-jet device from inadvertent oil-jet installation damage.

As well, in order to mitigate, at least in part, the above noted problems, a method has also been developed that includes: (A) spatially emplacing an oil-jet device at an installation position relative to an engine block of a vehicle, and (B) protectively sheltering the oil-jet device from inadvertent oil-jet installation damage.

Other aspects and features of the non-limiting embodiments may now become apparent to those skilled in the art upon review of the following detailed description of the non-limiting embodiments with the accompanying drawings.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
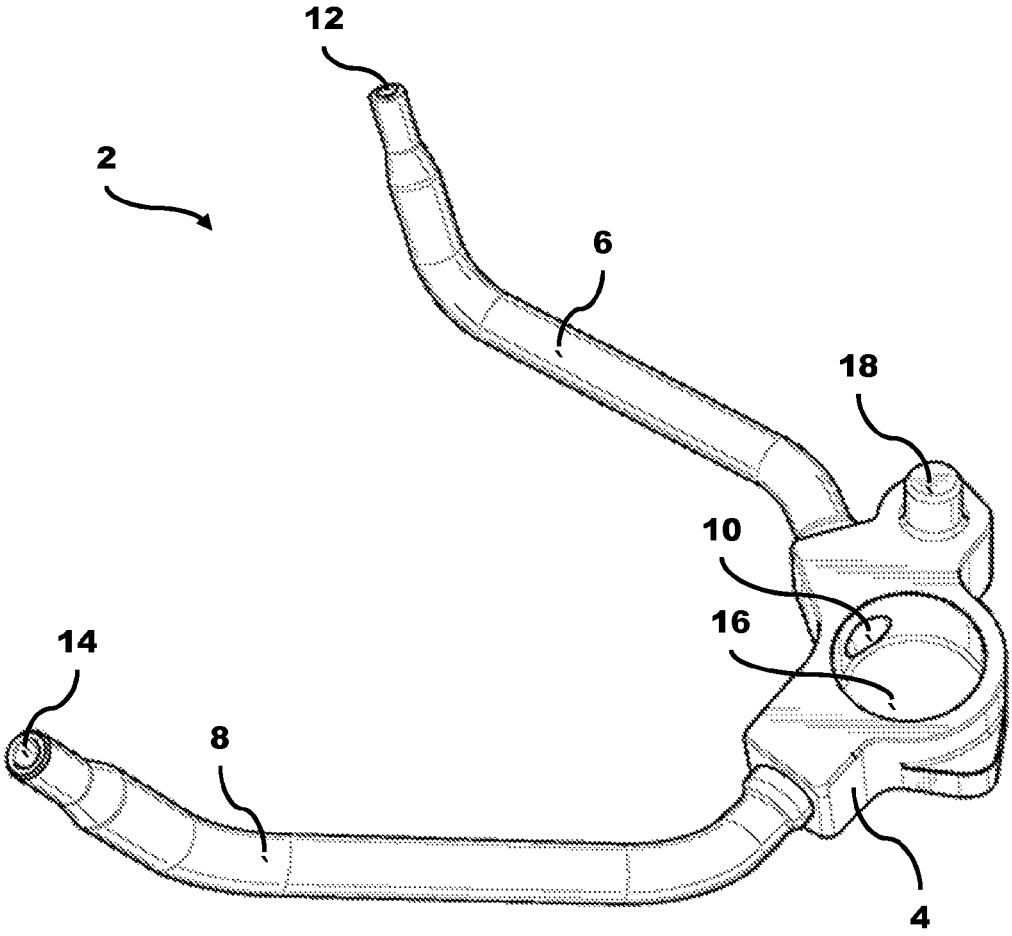
FIG. 1 depicts a perspective view of an example of an oil-jet device.

The drawings are not necessarily to scale and may be illustrated by phantom lines, diagrammatic representations and fragmentary views. In certain instances, details not necessary for an understanding of the embodiments (and/or details that render other details difficult to perceive) may have been omitted.

DETAILED DESCRIPTION OF EXEMPLARY EMBODIMENT(S)

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the examples as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments (examples) aspects and/or concepts defined in the appended claims. Hence, specific dimensions and other physical characteristics relating to the embodiments disclosed herein are not to be considered as limiting, unless the claims expressly state otherwise.

FIG. 1 depicts a perspective view of an example of an oil-jet device 2. The oil-jet device 2 is configured for installation and use with an engine block (not depicted and known) of a vehicle, such as an automobile or truck. The oil-jet device 2 is configured to spray oil to a piston assembly (such as a bottom portion of the piston assembly) of the engine block.

By way of the example depicted in FIG. 1, the oil-jet device 2 includes a base member 4 having a first fin member 6 and a second fin member 8. The first fin member 6 extends outwardly from the base member 4. As well, the second fin member 8 extends outwardly from the base member 4. The first fin member 6 is set apart from the second fin member 8. The first fin member 6 and the second fin member 8 are operatively attached to the base member 4.

The first fin member 6 and the second fin member 8 each have curved positions and straight positions. The first fin member 6 and the second fin member 8 are each tubular structures that define an oil channel extending from end to end. The base member 4 defines a first oil channel inlet 10 that is configured to be in fluid communication with the first fin member 6. The first fin member 6 defines a first oil channel outlet 12 configured to direct oil from the base member 4 to the piston assembly. The base member 4 also defines a second oil channel inlet (hidden from view) that is configured to be in fluid communication with the second fin member 8. The second fin member 8 defines a second oil channel outlet 14 configured to direct oil from the base member 4 to the piston assembly.

The base member 4 defines a chamber 16 extending from one side of the base member 4 to the other side of the base member 4. The chamber 16 is configured to receive a connection device 20, which is not depicted in FIG. 1 but is depicted in FIGS. 2B and 2C. The connection device 20 may also be called a bolt. The connection device 20 is configured to securely connect the oil-jet device 2 to the engine block. As well, the connection device 20 is configured to convey the oil from an oil circuit of the engine block to the base member 4, and the base member 4 then conveys the oil to the first fin member 6 and to the second fin member 8.

A jet-alignment datum 18 is provided by (extends from) the base member 4. The jet-alignment datum 18, also called a locating pin, is configured to align the base member 4 relative to the engine block during installation of the oil-jet device 2 to the engine block.

Figure 2A:
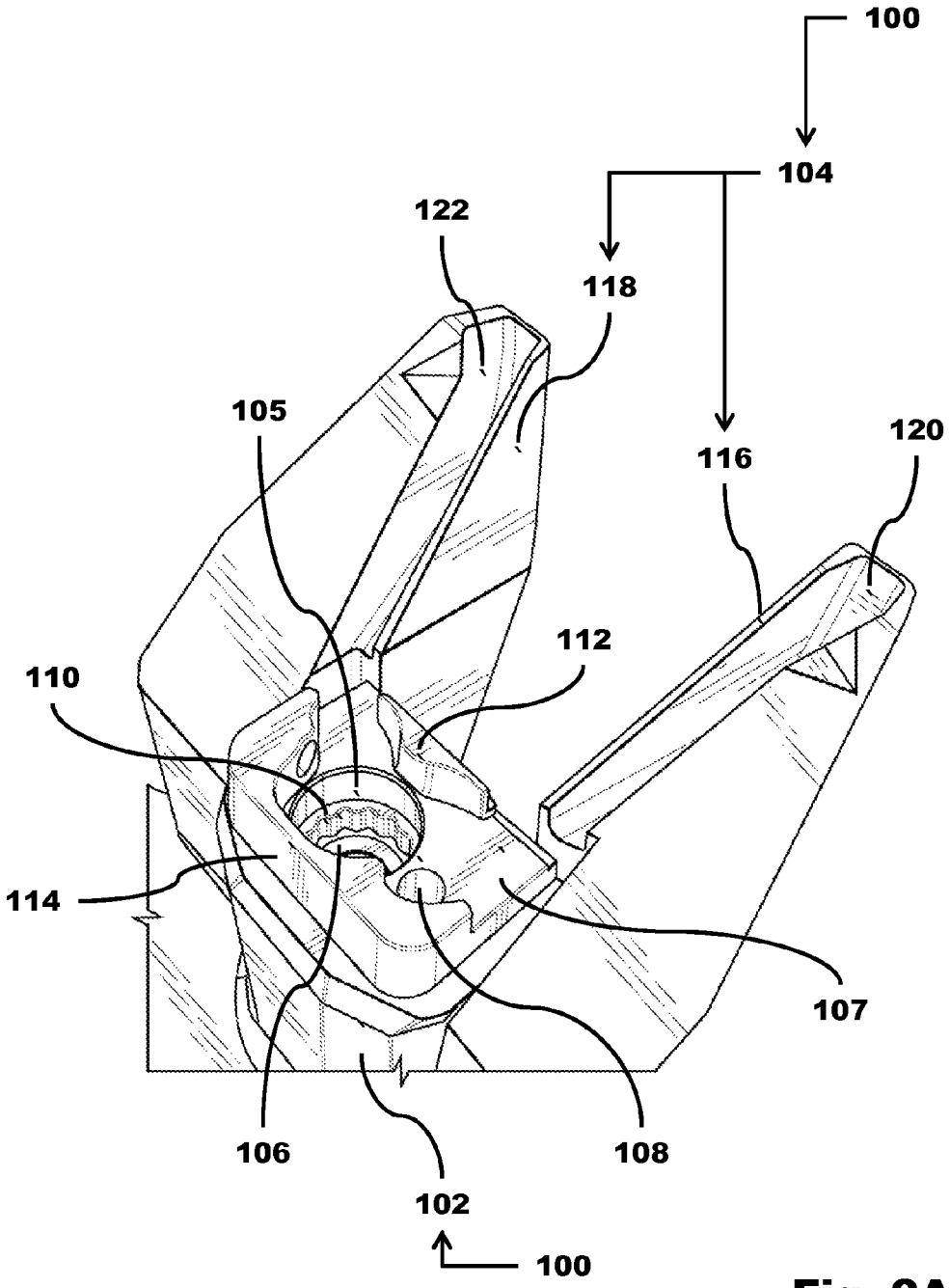
FIGS. 2A, 2B and 2C depict perspective views of an example of an apparatus configured for use with the oil-jet device of FIG. 1.
Figure 2B:
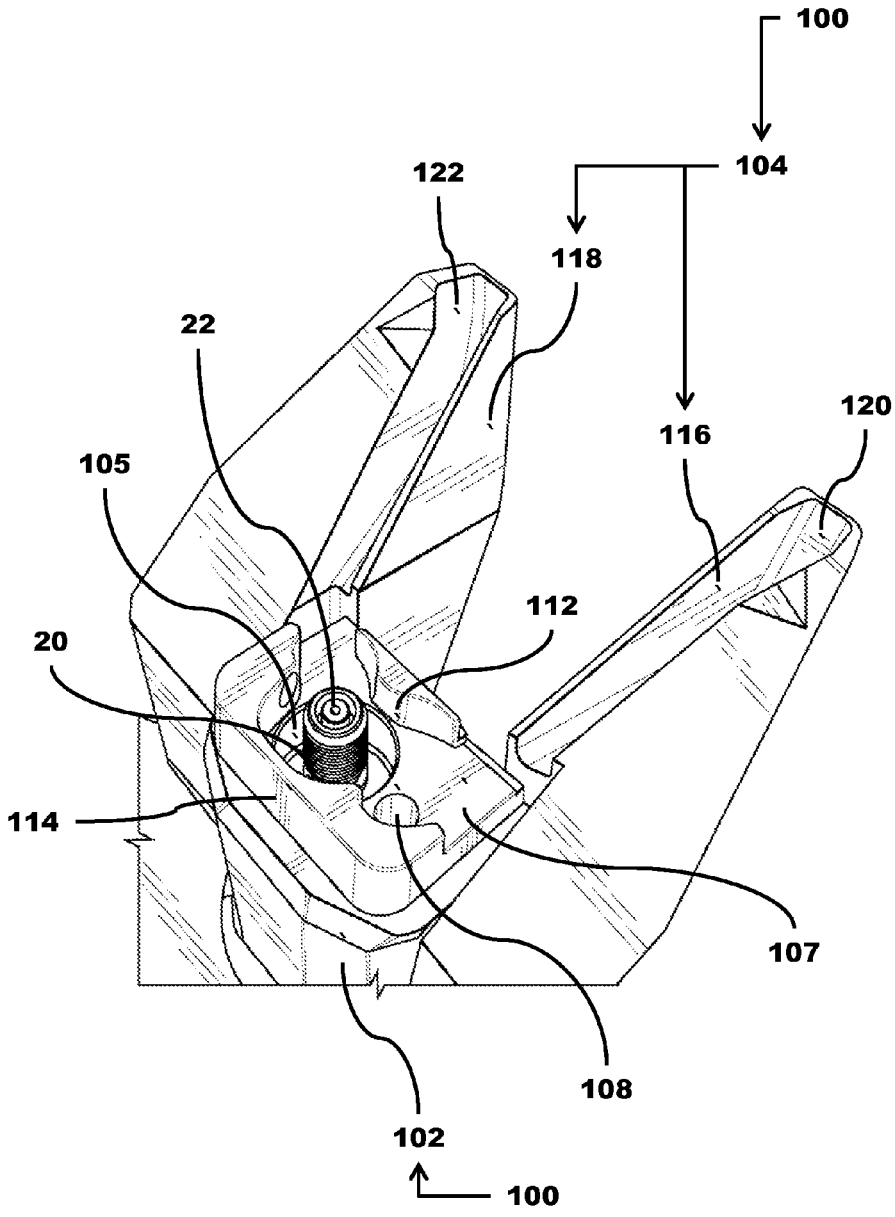
Figure 2C:
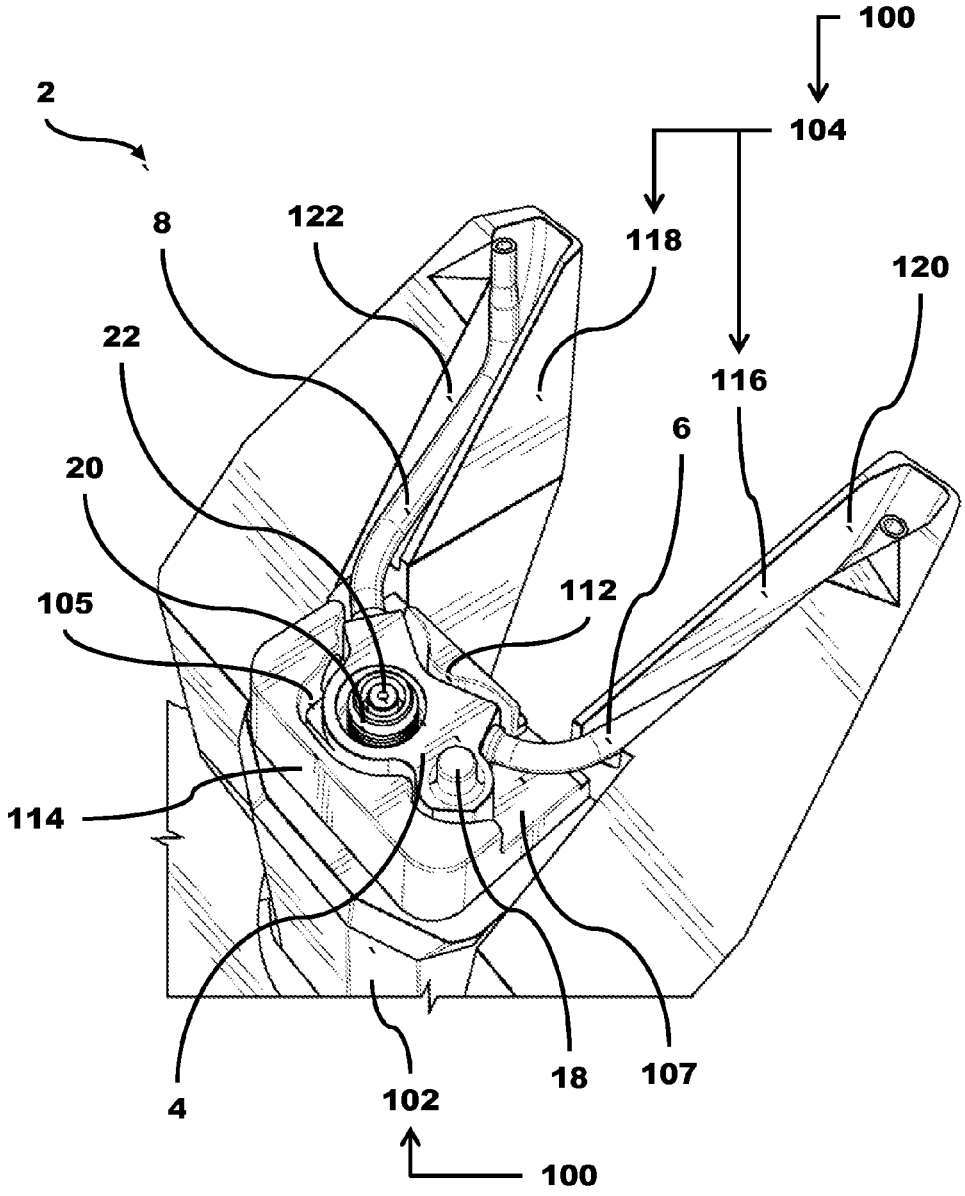

FIGS. 2A, 2B and 2C are perspective views of the example of the apparatus 100 configured for use with the oil-jet device 2 of FIG. 1. FIG. 2A depicts the case where the apparatus 100 is ready to receive the connection device 20 and the oil-jet device 2 of FIG. 1 prior to installation of the oil-jet device 2 to the engine block. FIG. 2A permits an unobstructed view of the apparatus 100 that may be otherwise obscured by the connection device 20 and the oil-jet device 2. FIG. 2B depicts the case where the apparatus 100 has received the connection device 20 and is ready to receive the oil-jet device 2 of FIG. 1. FIG. 2C depicts the case where the apparatus 100 has received both the connection device 20 and the oil-jet device 2, and the oil-jet device 2 is now ready to be installed to the engine block. The connection device 20 is configured to securely connect the oil-jet device 2 to the engine block in response to operation of an external tool system (as explained below).

Referring now to FIG. 2A, generally speaking, the apparatus 100 includes (but is not limited to) an oil-jet emplacement assembly 102 and an oil-jet sheltering assembly 104. The oil-jet emplacement assembly 102 is configured to spatially emplace (position) the oil-jet device 2 of FIG. 1 at an installation position relative to the engine block of the vehicle. The oil-jet sheltering assembly 104 is positioned relative to (set apart from or abuts) the oil-jet emplacement assembly 102. As well, the oil-jet sheltering assembly 104 is configured to protectively shelter the oil-jet device 2 from inadvertent oil-jet installation damage. For example, the oil-jet sheltering assembly 104 advantageously prevents unwanted damage to the structure and/or function of the oil-jet device 2 (such as accidental pinching of the oil-jet device 2) and thus advantageously prevents catastrophic operative failure of the engine block due to overheating of the piston assembly. To spatially emplace means to allow for installation orientation and positioning of the oil-jet device 2 during oil-jet installation. Emplacement is intended to mean a place where a thing is located; the act of placing something somewhere. To emplace is intended to mean to assign a position to something, or to locate something at a particular place.

The oil-jet sheltering assembly 104 is configured to receive and to shelter the oil-jet device 2 from oil-jet installation damage, such as damage to a portion of the oil-jet device 2, and/or a tip of the oil-jet device 2. The oil-jet sheltering assembly 104 is configured to receive and to shelter the oil-jet device 2. While the oil-jet device 2 is sheltered by the oil-jet sheltering assembly 104, the oil-jet sheltering assembly 104 positions (in use during oil-jet installation) the oil-jet device 2 at a position that is clear from (spaced apart from) so as to avoid inadvertent or unwanted contact with the engine block, such as a movable component (e.g., a crank component) of the engine block. The oil-jet sheltering assembly 104 is configured to keep (maintain) the oil-jet device 2 protected from: (A) inadvertent oil-jet damage during oil-jet installation, and (B) inadvertent oil-jet damage during normal operation of the engine block after oil-jet installation. The oil-jet sheltering assembly 104 advantageously ensures correct orientation of the tip of the oil-jet device 2 during oil-jet installation, and clearance between the oil-jet device 2 and the crank component of the engine block (and/or other components of the engine block) after oil-jet installation.

The problem associated with known oil-jet installation methods and or systems of the past was that during installation of the known oil-jet device to an engine block, there was potential for oil-jet damage for the case where the oil-jet device inadvertently contacted the engine block; as a result, the oil-jet device became bent or operatively damaged. The oil-jet sheltering assembly 104 advantageously facilitates clearance between the oil-jet device 2 and a part (such as a crank assembly) of the engine block so that interference between the oil-jet device 2 and the part of the engine block is avoided during engine-block operation.

It will be appreciated that the oil-jet emplacement assembly 102 is also configured to be removable from the oil-jet device 2 upon completion of oil-jet installation; as well, the oil-jet sheltering assembly 104 is also configured to be removable from the oil-jet device 2 upon completion of oil-jet installation so that the oil-jet emplacement assembly 102 and the oil-jet sheltering assembly 104 may be redeployed for installation of other instances of the oil-jet device 2.

Figure 3:
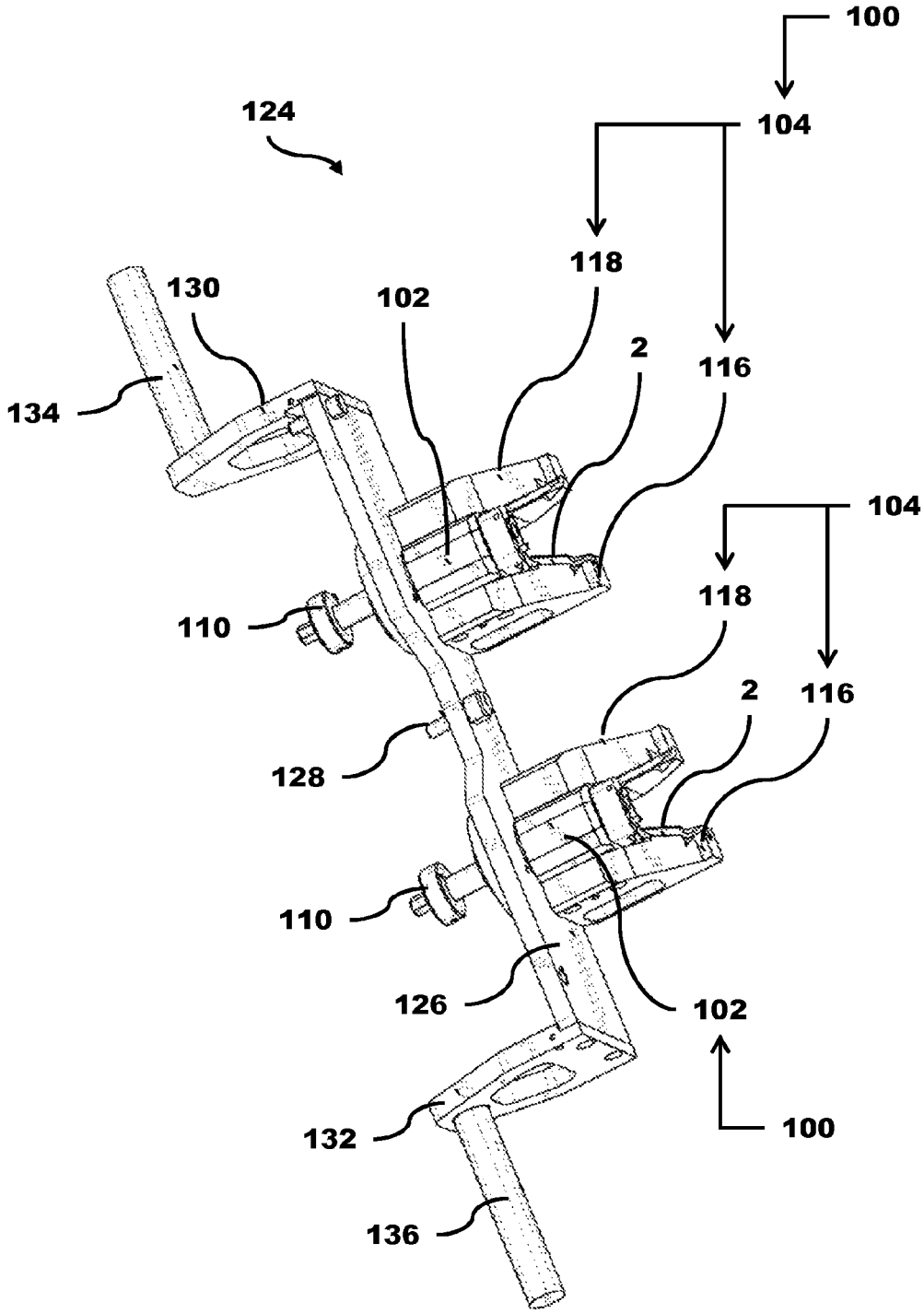
FIG. 3 depicts a perspective view of a jig assembly having instances of the apparatus of FIG. 2C.

More specifically, the oil-jet emplacement assembly 102 includes (and is not limited to) an interface 107 configured to interface the oil-jet emplacement assembly 102 with the base member 4 of the oil-jet device 2 of FIG. 1. The interface 107 includes a first magnet device 106 and a second magnet device 108 set apart from the first magnet device 106. The first magnet device 106 is configured to magnetically retain the connection device 20 (depicted in FIG. 2B) to the oil-jet emplacement assembly 102 during installation of the oil-jet device 2 to the engine block. After the oil-jet device 2 is installed to the engine block, the attraction force (retaining force) of the first magnet device 106 can no longer retain or attach with the connection device 20. The second magnet device 108 is configured to magnetically retain the oil-jet device 2 to the oil-jet emplacement assembly 102 during installation of the oil-jet device 2 to the engine block. After the oil-jet device 2 is installed to the engine block, the attraction force (retaining force) of the second magnet device 108 can no longer retain or attach with the oil-jet device 2. The interface 107 is also configured to operatively accommodate a tool interface 110, which is also depicted in FIG. 3. The tool interface 110 is configured to operatively couple to the connection device 20, which is depicted in FIG. 2B. The tool interface 110 is configured to transmit a force (rotation force) from a tool assembly (such as a rotatable tool) to the connection device 20 so that the connection device 20 may then securely connect the oil-jet device 2 to the engine block. The rotatable tool may be, for instance, a direct current (DC) based tool system in which a torque (connection force) applied by the tool system to the connection device 20 via the tool interface 110 may be controlled to a required amount to ensure proper connection of the connection device 20 to the engine block.

As well, the interface 107 includes a first wall 112 and a second wall 114 that is set apart from the first wall 112. The oil-jet device 2 is received (positioned) between the first wall 112 and the second wall 114. The oil-jet device 2 may abut the first wall 112 and abut the second wall 114. Specifically, the base member 4 of the oil-jet device 2 is to be received and located between the first wall 112 and the second wall 114 as depicted in FIG. 2C.

The interface 107 also defines a recess 105. The recess 105 is configured to receive, at least in part, the connection device 20, which is depicted in FIG. 2B. The tool interface 110 is located in the recess 105 so that the tool interface 110 is set apart from the interface 107. The first magnet device 106 is located in the recess 105 so that the first magnet device 106 is set apart from the interface 107. The first magnet device 106 is also located adjacent to the tool interface 110 in the recess 105.

The oil-jet sheltering assembly 104 includes (but is not limited to) a first wing structure 116 and a second wing structure 118 that is set apart from the first wing structure 116. The first wing structure 116 defines a first cradle 120. The second wing structure 118 defines a second cradle 122. The first cradle 120 is configured to receive the first fin member 6 (from an installer), and also configured to cradle the first fin member 6 during installation of the oil-jet device 2 of FIG. 1. The second cradle 122 is configured to receive the second fin member 8 (from an installer), and to cradle the second fin member 8 during installation of the oil-jet device 2 of FIG. 1. The first cradle 120 and the second cradle 122 are configured to (securely) shield the first fin member 6 and the second fin member 8 (respectively) from inadvertent blows or strikes to the first fin member 6 and the second fin member 8 during installation of the oil-jet device 2 of FIG. 1 to the engine block. Inadvertent strikes or blows may damage the first fin member 6 and the second fin member 8 either partially or completely which may lead to engine-block failure at worst, or noisy operation of the engine block, or overheating of the engine block (which may shorten life span of the engine block).

Generally speaking, the first wing structure 116 and the second wing structure 118 are configured to provide a protection shape configured to securely interface with (and receive) the first fin member 6 and the second fin member 8. By way of example, the first wing structure 116 and the second wing structure 118 may include a correspondingly shaped nylon-based structure configured to receive and to protectively shield structural aspects of the oil-jet device 2. The correspondingly shaped nylon-based structure includes (for instance) a nylon block forming a path configured to conform, at least in part, to the shape of the oil-jet device 2.

Referring now to FIG. 2B, the oil-jet emplacement assembly 102 receives the connection device 20 in the recess 105; that is, an installer manually placed the connection device 20 on the oil-jet emplacement assembly 102, or an automatic system (such as a robot system) placed the connection device 20 in the oil-jet emplacement assembly 102. The first magnet device 106 of FIG. 2A magnetically retains the connection device 20 in position located in the recess 105. The connection device 20 defines a fluid passageway 22 configured to fluidly connect with the oil passageways defined by the first fin member 6 and by the second fin member 8 and by the base member 4 of the oil-jet device 2 of FIG. 1. The oil-jet device 2 is not depicted as being installed (received) in apparatus 100 of FIG. 2B so as to provide an unobstructed view of the connection device 20.

Referring now to FIG. 2C, the oil-jet emplacement assembly 102 receives the connection device 20, and the oil-jet sheltering assembly 104 securely receives the oil-jet device 2 of FIG. 1. The first fin member 6 is received and positioned in the first cradle 120. The second fin member 8 is received and positioned in the second cradle 122. The base member 4 is received and positioned between the first wall 112 and the second wall 114. The connection device 20 is received and positioned in the chamber 16 of the base member 4. The head of the connection device 20 is received in the recess 105 and is also obscured from view by the base member 4. The head of the connection device 20 is positioned behind (underneath) the base member 4. The jet-alignment datum 18 extends upwardly from the base member 4. The oil-jet device 2, as depicted in FIG. 2C, is now ready to be installed to the engine block.

FIG. 3 depicts a perspective view of a jig assembly 124 having instances of the apparatus 100 of FIG. 2C. The jig assembly 124 is used, by the installer, to install multiple instances of the oil-jet device 2 to the engine block. The jig assembly 124 includes (and is not limited to): a frame assembly 126, a frame-alignment datum 128, a first support member 130, a second support member 132, a first shaft member 134, and a second shaft member 136. It will be appreciated that the apparatus 100 may include the jig assembly 124. The frame assembly 126 is configured to securely support (either directly or indirectly) at least one or more instances of the oil-jet emplacement assembly 102 and of the oil-jet sheltering assembly 104. Instances of the apparatus 100 are spaced apart from each other so that each instance of the apparatus 100 may be used to install corresponding instances of the oil-jet device 2 at corresponding piston assemblies of the engine block. For the sake of simplifying FIG. 3, two instances of the apparatus 100 are depicted. The frame-alignment datum 128 extends from the frame assembly 126. The frame-alignment datum 128 is configured to locate desired or appropriate position of the frame assembly 126 to the engine block so that the instances of the apparatus 100 may be positioned at the appropriate corresponding positions relative to the engine block.

The first support member 130 extends from the frame assembly 126. The second support member 132 extends from the frame assembly 126, and the second support member 132 is set apart from the first support member 130, so that the first support member 130 are the second support member 132 are positioned on opposite sides of the frame assembly 126. The first shaft member 134 is connected to (and extends from) the first support member 130. The second shaft member 136 is connected to (and extends from) the second support member 132. The first shaft member 134 is coaxially aligned with the second shaft member 136. The first shaft member 134 and the second shaft member 136 are translatable (rotatable).

In operation, the first shaft member 134 and the second shaft member 136 may be actuated to move the position of the frame assembly 126 between an oil-jet receiving position and an oil-jet installation position. In the oil-jet receiving position, the apparatus 100 is ready to receive an instance of the connection device 20 and an instance of the oil-jet device 2, as depicted in FIG. 2A, at an out-board position relative to the engine block. In the oil-jet installation position, the apparatus 100 is placed (positioned by the jig assembly 124) such that the connection device 20 and the oil-jet device 2 are spatially positioned at an in-board position relative to the engine block (that is, a position that is located in-board of the engine block), ready for installation to the engine block. In the oil-jet installation position, the tool interface 110 is now actuated to install the connection device 20 so as to connect the oil-jet device 2 to the engine block. The connection device 20 securely retains the oil-jet device 2 of FIG. 1 to the engine block.

The frame assembly 126 is configured to accommodate the tool interface 110 of the apparatus 100. More specifically, the frame assembly 126 is configured to accommodate instances of the tool interface 110 of each instance of the apparatus 100. The tool interface 110 extends through the oil-jet emplacement assembly 102 from one side to reach the opposite side. The torque applied to the tool interface 110 may be recorded and/or monitored. Once the oil-jet device 2 is installed to the engine block, the frame assembly 126 may be translated from the oil-jet installation position to the oil-jet receiving position so that another instance of the connection device 20 and of the oil-jet device 2 may be received by the apparatus 100 so that the oil-jet installation process may then be repeated as often as required.

Figure 4A:
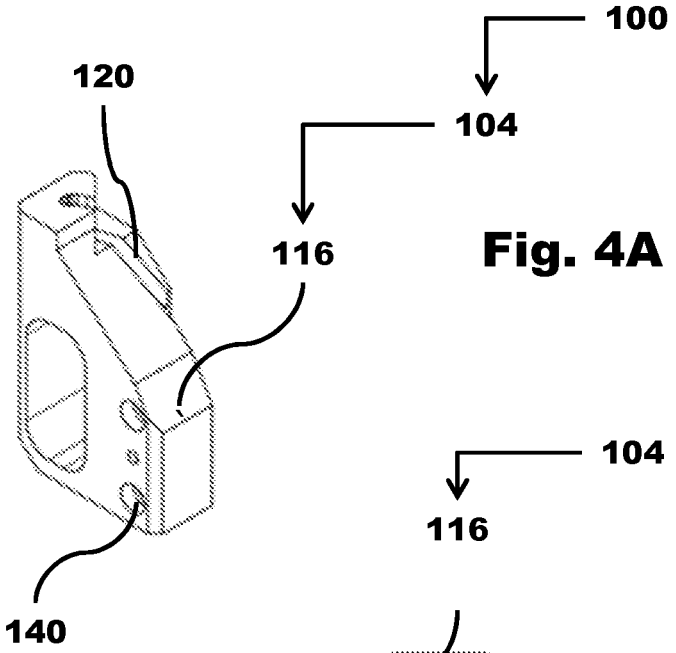
FIGS. 4A, 4B and 4C depict close-up views of an example of a first wing structure of the apparatus of FIG. 2A.
Figure 4B:
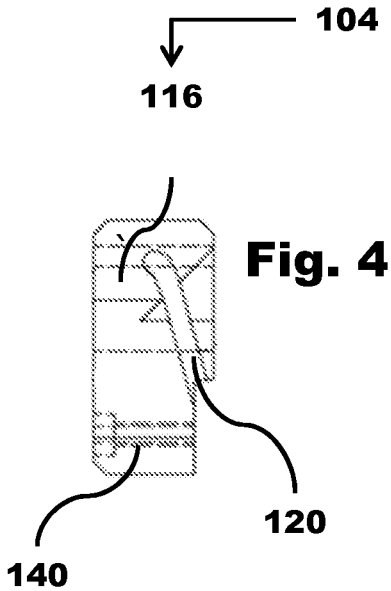
Figure 4C:
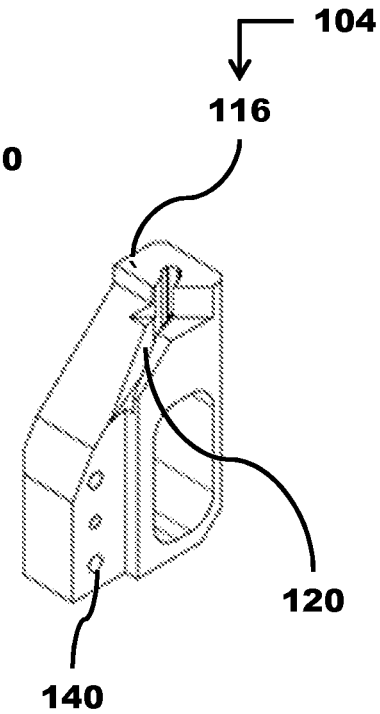

FIGS. 4A, 4B and 4C depict the close-up views of an example of the first wing structure 116 of the apparatus 100 of FIG. 2A. FIG. 4A depicts a side perspective view of the first wing structure 116. The first wing structure 116 may be shaped to accommodate ergonomic requirements of the installer while facilitating protective sheltering of the oil-jet device 2. For example, the first wing structure 116 defines a fastening hole 140 configured to facilitate connection of the first wing structure 116 with the oil-jet emplacement assembly 102 of FIG. 2A and/or with the frame assembly 126 of FIG. 3. FIG. 4B depicts a top view of the first wing structure 116. FIG. 4C depicts another side perspective view of the first wing structure 116. It will be appreciated that the second wing structure 118 of FIG. 2A may be shaped to mirror the shape of the first wing structure 116 as depicted in FIGS. 4A, 4B and 4C.

In view of the foregoing, an installation method is provided. The method includes various operations associated with using the apparatus 100. The method includes (and is not limited to) an operation (A), an operation (B), an operation (C) and an operation (D). The operation (A) includes locating the connection device 20 within the recess 105 of the oil-jet emplacement assembly 102. The operation (B) includes magnetically positioning (at least in part) the oil-jet device 2 on the oil-jet sheltering assembly 104 such that the first fin member 6 and the second fin member 8 securely rest within corresponding nylon protective structures of the oil-jet sheltering assembly 104. The operation (C) includes rotating and aligning the oil-jet emplacement assembly 102 once the first fin member 6 and the second fin member 8 of the oil-jet device 2 are properly positioned for oil-jet installation, and the jet-alignment datum 18 can then be positioned or located in registration with the engine block, thereby operatively positioning the oil-jet device 2 relative to the engine block and the piston cylinders at the oil-jet installation position. During the oil-jet installation operation, the protective nylon structures of the oil-jet sheltering assembly 104 securely protect the first fin member 6 and the second fin member 8 of the oil-jet device 2 from inadvertent oil-jet damage. The operation (D) includes fastening the oil-jet device 2 to the engine block by using an external tool via the tool interface 110 as described above. Specifically, the connection device 20 of the oil-jet device 2 is secured to the engine block. The oil-jet sheltering assembly 104 maintains the oil-jet device 2 in a set-apart relationship from a movable part of the engine block during oil-jet installation, so that the oil-jet device 2 does not become prone to inadvertent contact with the movable part of the engine block during engine-block operation. As a result, during engine-block operation, the oil-jet device 2 avoids becoming an unwanted source of undesired engine-block noise, and avoids experiencing catastrophic oil-jet operational failure, etc.

The oil-jet sheltering assembly 104 is also configured to facilitate detection of a damaged instance of the oil-jet device 2, such as for the case where the oil-jet device 2 is bent or misshaped. A misshaped instance of the oil-jet device 2 cannot be entirely received by the oil-jet sheltering assembly 104, and visual and/or tactile inspection by an installer may verify the status of the misshaped instance of the oil-jet device 2. Detection of a damaged instance of the oil-jet device 2 advantageously allows removal of the damaged instance of the oil-jet device 2 and subsequent insertion of an acceptable instance of oil-jet device 2. The protective nest of the oil-jet sheltering assembly 104 makes detection of bent or damaged instances of the oil-jet device 2 easier for the installer where a shape mismatch may be identified between a given instance of the oil-jet device 2 and the shape of the protective nest of the oil-jet sheltering assembly 104. Advantageously, the oil-jet sheltering assembly 104 avoids rejection of the engine block of a vehicle on account of abnormal (unwanted) noise resulting from unacceptable instances of the oil-jet device 2.

The following description provides general characterizations of the oil-jet sheltering assembly 104: the oil-jet sheltering assembly 104 is shaped to protectively engage, at least in part, the oil-jet device 2. The oil-jet sheltering assembly 104 is configured to at least partially protectively encase the oil-jet device 2. The oil-jet sheltering assembly 104 is configured to reduce, at least in part, the likelihood of oil-jet installation damage during oil-jet installation. The oil-jet sheltering assembly 104 provides a protective profile configured to receive, at least in part, a portion of the oil-jet device 2. The oil-jet sheltering assembly 104 is shaped to mimic, at least in part, an outer surface of the oil-jet device 2. The oil-jet sheltering assembly 104 is configured to mimic, at least in part, a target surface region of the oil-jet device 2. The oil-jet sheltering assembly 104 is configured to nestably receive, at least in part, the oil-jet device 2. Nestable (nesting) means the oil-jet device 2 is received and fits (at least in part) in the oil-jet sheltering assembly 104, much like the nesting of an object in another object. Protective nesting of the oil-jet device 2 includes safely holding the oil-jet device 2 in place during oil-jet installation so as to avoid inadvertent damage to the oil-jet device 2.

The apparatus 100 facilitates: (A) desired orientation of a tip of the oil-jet device 2, (B) clearance to a crank or components of the engine block, and (C) protects (at least in part) overall function of the oil-jet device 2. The oil-jet sheltering assembly 104 is configured to provide a protective nest structure that protectively nests the oil-jet device 2 during oil-jet installation. The oil-jet sheltering assembly 104 is configured to protectively (and correctly) orient position of the oil-jet device 2 during oil-jet installation, such as the tip of the oil-jet device 2. The oil-jet sheltering assembly 104 is configured to facilitate positioning of the tip of the oil-jet device 2 to ensure proper functioning of the tip. Consequently, the oil-jet sheltering assembly 104, in use, reduces (or eliminates) occurrences of inadvertent oil-jet damage during oil-jet installation. The oil-jet sheltering assembly 104 is configured to protect the oil-jet device 2 from inadvertently making contact during oil-jet installation to the engine block.

It may be appreciated that the assemblies and modules described above may be connected with each other as may be required to perform desired functions and tasks that are within the scope of persons of skill in the art to make such combinations and permutations without having to describe each and every one of them in explicit terms. There is no particular assembly or components that is superior to any of the equivalents available to the art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) description provided outside of this document (that is, outside of the instant application as filed, as prosecuted, and/or as granted). It is understood, for the purposes of this document, the phrase "includes (and is not limited to)" is equivalent to the word "comprising." It is noted that the foregoing has outlined the non-limiting embodiments (examples). The description is made for particular non-limiting embodiments (examples). It is understood that the non-limiting embodiments are merely illustrative as examples.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus for installing an oil jet device, of a type including a base member and at least one fin member, comprising:

an oil-jet emplacement assembly including an interface to receive the base member, and being configured to spatially emplace an oil-jet device at an installation position relative to an engine block of a vehicle; and an oil-jet sheltering assembly including at least one wing structure to receive the corresponding fin member, and being positioned relative to the oil-jet emplacement assembly, the oil-jet sheltering assembly being configured to protectively shelter the oil-jet device from inadvertent oil-jet installation damage.

2. The apparatus of claim 1, wherein:

the oil-jet sheltering assembly maintains the oil-jet device in a set-apart relationship from a movable part of the engine block during oil-jet installation, so that the oil-jet device does not become prone to inadvertent contact with the movable part of the engine block during engine-block operation.

3. The apparatus of claim 1, wherein the at least one wing structure includes a correspondingly shaped nylon-based structure configured to receive, at least in part, the oil-jet device.

4. The apparatus of claim 1, wherein the at least one wing structure includes a cradle shaped to complement the corresponding fin, and wherein the oil-jet sheltering assembly is shaped to protectively engage, at least in part, the oil-jet device, when the cradle cannot receive the fin.

5. The apparatus of claim 1, wherein the oil-jet sheltering assembly is configured to facilitate detection of a damaged instance of the oil-jet device.

6. The apparatus of claim 1, wherein the oil-jet sheltering assembly provides a protective profile configured to receive, at least in part, a portion of the oil-jet device.

7. The apparatus of claim 1, wherein the oil-jet sheltering assembly is shaped to mimic, at least in part, an outer surface of the oil-jet device.

8. The apparatus of claim 1, wherein the oil-jet sheltering assembly is configured to mimic, at least in part, a target surface region of the oil-jet device.

9. The apparatus of claim 1, wherein the oil-jet sheltering assembly is configured to provide a protective nest structure that protectively nests the oil-jet device during oil-jet installation.

10. The apparatus of claim 1, wherein the oil-jet emplacement assembly includes:

an interface configured to interface the oil-jet emplacement assembly with a base member of the oil-jet device, and the interface includes:

a first magnet device configured to magnetically retain a connection device to the oil-jet emplacement assembly during installation of the oil-jet device to the engine block, and once installed, an attraction force of the first magnet device can no longer retain or attach with the connection device; and a second magnet device set apart from the first magnet device, the second magnet device configured to magnetically retain the oil-jet device to the oil-jet emplacement assembly during installation of the oil-jet device to the engine block, and once installed, the attraction force of the second magnet device can no longer retain or attach with the oil-jet device.

11. The apparatus of claim 10, wherein the interface further includes:

a tool interface extending through the interface configured to operatively couple to the connection device, the tool interface configured to transmit a force from a tool assembly to the connection device so that the connection device may then become securely connected to the engine block.

12. The apparatus of claim 10, wherein the interface further includes:

a first wall;

a second wall set apart from the first wall, the oil-jet device being receivable, at least in part, between the first wall and the second wall; and a recess configured to receive, at least in part, the connection device.

13. An apparatus for installing an oil jet device, of a type including a base member and at least one fin member, comprising:

an oil-jet emplacement assembly including an interface to receive the base member, and being configured to spatially emplace an oil-jet device at an installation position relative to an engine block of a vehicle; and an oil-jet sheltering assembly including at least one wing structure to receive the corresponding fin member, and being positioned relative to the oil-jet emplacement assembly, the oil-jet sheltering assembly being configured to protectively shelter the oil-jet device from inadvertent oil-jet installation damage, wherein:

the oil-jet emplacement assembly is configured to be removable from the oil-jet device upon completion of oil-jet installation; and the oil-jet sheltering assembly is configured to be removable from the oil-jet device upon completion of oil-jet installation.

14. An apparatus, comprising:

an oil-jet emplacement assembly being configured to spatially emplace an oil-jet device at an installation position relative to an engine block of a vehicle; and an oil-jet sheltering assembly being positioned relative to the oil-jet emplacement assembly, and the oil-jet sheltering assembly being configured to protectively shelter the oil-jet device from inadvertent oil-jet installation damage, wherein:

the oil-jet sheltering assembly includes:

a first wing structure defining a first cradle configured to receive and to cradle a first fin member of the oil-jet device during installation of the oil-jet device; and a second wing structure being set apart from the first wing structure, the second wing structure defining a second cradle configured to receive and to cradle a second fin member of the oil-jet device during installation of the oil-jet device;

wherein the first cradle and the second cradle are configured to shield the first fin member and the second fin member, respectively, from inadvertent strikes to the first fin member and the second fin member during installation of the oil-jet device.

15. An apparatus, comprising:

an oil-jet emplacement assembly being configured to spatially emplace an oil-jet device at an installation position relative to an engine block of a vehicle; and an oil-jet sheltering assembly being positioned relative to the oil-jet emplacement assembly, and the oil-jet sheltering assembly being configured to protectively shelter the oil-jet device from inadvertent oil-jet installation damage, wherein:

the oil-jet sheltering assembly includes a first wing structure and a second wing structure that provides a protection shape configured to interface and receive a first fin member and a second fin member of the oil-jet device.

16. An apparatus, comprising:

an oil-jet emplacement assembly being configured to spatially emplace an oil-jet device at an installation position relative to an engine block of a vehicle; and an oil-jet sheltering assembly being positioned relative to the oil-jet emplacement assembly, and the oil-jet sheltering assembly being configured to protectively shelter the oil-jet device from inadvertent oil-jet installation damage, wherein:

the oil-jet sheltering assembly includes a first wing structure and a second wing structure that include a correspondingly shaped nylon-based structure configured to receive and to shield structural aspects of the oil-jet device.

17. An apparatus, comprising:

an oil-jet emplacement assembly being configured to spatially emplace an oil-jet device at an installation position relative to an engine block of a vehicle;

an oil-jet sheltering assembly being positioned relative to the oil-jet emplacement assembly, and the oil-jet sheltering assembly being configured to protectively shelter the oil-jet device from inadvertent oil-jet installation damage; and a jig assembly including:

a frame assembly; and a frame-alignment datum;

wherein the frame assembly is configured to securely support the oil-jet emplacement assembly and the oil-jet sheltering assembly, and the frame-alignment datum extends from the frame assembly and is configured to locate the position of the frame assembly to the engine block; and wherein, the jig assembly further includes:

a first support member;

a second support member;

a first shaft member; and a second shaft member;

the first support member extends from the frame assembly;

the second support member extends from the frame assembly, and the second support member is set apart from the first support member;

the first shaft member is connected to the first support member;

the second shaft member is connected to the second support member, the first shaft member is coaxially aligned with the second shaft member, the first shaft member and the second shaft member are translatable, so that the frame assembly may be positioned between an oil-jet receiving position and an oil-jet installation position;

in the oil-jet receiving position, the apparatus is ready to receive a connection device and the oil-jet device at an out-board position relative to the engine block;

in the oil-jet installation position, the apparatus is placed such that the connection device and the oil-jet device at the engine block at an in-board position relative to the engine block; and the frame assembly is configured to accommodate a tool interface of the apparatus.

18. A method of installing an oil-jet device, comprising:

using an oil-jet installation apparatus to install the oil-jet, the oil-jet installation apparatus having an oil-jet emplacement assembly for spatially emplacing the oil-jet device at an installation position relative to an engine block of a vehicle, and an oil-jet sheltering assembly positioned relative to the oil-jet emplacement assembly such that the oil-jet device is protectively sheltered from inadvertent oil-jet installation damage.

19. The method of claim 18, further comprising:

locating a connection device within a recess of the oil-jet emplacement assembly;

magnetically positioning the oil-jet device on the oil-jet sheltering assembly such that a first fin member and a second fin member may securely rest;

rotating and aligning the oil-jet emplacement assembly once the oil-jet device is properly positioned for oil-jet installation and once a jet-alignment datum is positioned with the engine block; and fastening the oil-jet device to the engine block.

* * * * *